United States Patent [19]

Iwanari et al.

[11] 4,068,204

[45] Jan. 10, 1978

[54] THERMAL FUSE EMPLOYING A SLIDABLE RESILIENT CONTACT MEMBER IN A CONDUCTIVE HOUSING

[75] Inventors: Sadayoshi Iwanari, Kusatsu; Osamu Umene, Otsu, both of Japan

[73] Assignee: New Nippon Electric Company, Ltd., Osaka, Japan

[21] Appl. No.: 752,725

[22] Filed: Dec. 21, 1976

[30] Foreign Application Priority Data

Dec. 26, 1975 Japan ..... 50-178425[U]

[51] Int. Cl.[2] ..... H01H 37/76

[52] U.S. Cl. ..... 337/408; 337/409

[58] Field of Search ..... 337/407, 408, 409

[56] References Cited

U.S. PATENT DOCUMENTS

| | | | |
|---|---|---|---|
| 3,727,164 | 4/1973 | Cartier et al. | 337/409 X |
| 3,778,742 | 12/1973 | Merrill | 337/408 X |
| 3,944,960 | 3/1976 | Audette et al. | 337/408 |
| 4,001,754 | 1/1977 | Plasko | 337/407 |

*Primary Examiner*—George Harris

*Attorney, Agent, or Firm*—W. G. Fasse; W. W. Roberts

[57] ABSTRACT

A thermal fuse comprises an electrically and thermally conductive housing hermetically sealing switch parts of a fusible temperature-sensitive pellet, metallic plates, compression springs and a slidable resilient contact member. The contact member has a center contact portion at its bottom base and a peripheral contact portion with a plurality of tongues extending from the bottom base. The contact member of resilient conductive material is shaped to form a portion sloping over the bottom base and to form peripheral tongues extending relative to the flat surface of the assembled metallic plate when no external force is applied. The shaped contact member with its peripheral tongues has an outer diameter equal to, or smaller than, the inside diameter of the housing when no external force is applied, whereas the application of a biasing force of one of two compression springs to the contact member expands the outer diameter thereof to be larger than the inside diameter of the housing case to maintain a sufficient contact force between the contact member and the housing.

5 Claims, 6 Drawing Figures

PRIOR ART

THERMAL FUSE EMPLOYING A SLIDABLE RESILIENT CONTACT MEMBER IN A CONDUCTIVE HOUSING

BACKGROUND OF THE INVENTION

This invention relates to a temperature responsive electric switch provided with a thermal fuse of the non-reset type, operable to open a circuit at a specific temperature. More particularly the invention relates to an improvement of a slidable contact member used in such thermal fuses, wherein the slidable contact member moves when a temperature-sensitive pellet is fused.

It is known to use overheating prevention devices to open a circuit when the temperature of an electric apparatus exceeds a given range, to increase the safety of the apparatus. Conventionally, this kind of overheating preventing device includes two well-known types. One type is the non-reset type employing metals fusible at a specific temperature. Another type is self-resetting and uses bimetal thermocouple means. The non-reset type has the disadvantage that the metal surface degenerates by oxidation or the like with the lapse of time, whereby the response or working temperature is changed, resulting in its unstable function. On the other hand, the bimetal-type is also disadvantageous, in that even when it once functions to open the circuit, a drop in the ambient temperature allows the device to reset and start a current flow. The switch-on and-off operation may thus be repeated unless the power supply is cut off, or the cause of the fault is eliminated. Thus, heat may be gradually stored in the bimetal device also changing the response temperature.

Recently a thermal fuse of the non-reset type employing a temperature-sensitive pellet fusible at a specific temperature has been widely used. This kind of thermal fuse, which houses the temperature-sensitive pellet within a sealed vessel, has the advantage that the fuse is always stable in its function for a long time in the absence of external changes. Such pellet fuses also do not store any heat due to its non-reset characteristic, whereby the desired safety results.

This invention relates to improvements of thermal fuses employing a temperature-sensitive pellet. This type of pellet fuse will now be explained.

A typical conventional thermal pellet fuse of the non-reset type is described, for instance in U.S. Pat. No. 3,519,972. Such pellet fuse comprises a cylindrical housing made of a metal having a good conductivity for electricity and heat. The switching parts include a temperature-sensitive pellet, disc-like metallic plates, and two types of compression spring means arranged within a housing or vessel.

The device further includes a resilient contact member of which the peripheral portion abuts against the inner wall of the metallic housing. These parts are hermetically sealed by means of insulator materials and a lead-in wire passes through the insulator sealing means. The two types of compression springs are formed so that one of the springs has a greater resiliency than the other, while the other spring has a greater restoring force than the former.

In the above structure, the conventional resilient contact member is provided with many circumferential tongues and has, before assembly, the outer diameter $D_1$ (FIG. 6) sufficiently larger than the inner diameter $D_2$ of the metallic housing shown in FIG. 3. Such a contact member has a flat base portion and tongues forming contact portions extending outwardly under pressure against the inner wall of the housing to increase the resiliency of the tongues so that the tongues prevent the compression spring having a smaller resiliency from properly expanding or contracting even when the temperature-sensitive pellet is molten, whereby the above mentioned problems occur. Therefore, providing a thermal fuse in which the pellet of meltable material, allows the contact member to separate the contact portion of the lead-in wire quickly, exactly, and to a desired extend, is very desirable.

Besides, this prior art kind of a small-sized thermal fuse is difficult to assemble because it is hard to insert the resilient contact member into the housing. The resilient contact member is especially required to maintain the contact pressure against the inner housing wall after assembly. It is also difficult to achieve an accurate location of the resilient contact member.

OBJECTS OF THE INVENTION

In view of the foregoing, it is the aim of the invention to achieve the following objects, singly or in combination:

- to improve a thermal fuse of the above type to avoid the deficiencies of the prior art and which is capable of allowing a resilient contact member to rapidly and exactly leave an opposite contact to provide a given spacing therebetween when a temperature-sensitive pellet melts;
- to provide an improved, slidable, resilient contact member which is simple to construct, inexpensively manufactured and easily assembled; and
- to provide fuses of uniform quality and uniform response characteristic.

SUMMARY OF THE INVENTION

According to the invention, there is provided a temperature responsive electric thermal fuse switch comprising a metallic cylinderical housing having one open end, a first lead or conductor member electrically fixed to the vessel, a temperature-sensitive pellet fusible at the predetermined temperature, retaining plates opposite to each other through first compression spring means having a comparatively strong resiliency and a short stroke, a slidable resilient contact member having a central contacting portion and a plurality of peripheral contacting portions, second compression spring means having a comparatively weak resiliency and long stroke, an insulator for closing the open end of the housing, a second conductor member or lead-in wire passing through the insulator material and having at the tip a contact portion, and insulated sealing means for hermetically sealing and fixing the housing, insulator and second lead member to each other, wherein the resilient contact member is biased at its peripheral contacting portions against the inner wall of the housing and at the central contacting portion against the contact portion of the second lead member, wherein the improvement is characterized in that the resilient contact member is formed in such a manner that the central contacting portion is of a diameter equal to or smaller than an inner diameter of the housing and a plurality of peripheral stripped contacting fingers extend radially from the central contaction portion to form an integral structure, e.g., by punching; both the central contacting portion and the peripheral contacting fingers are interconnected by a slanting portion therebetween, and the peripheral contacting fingers are shaped to have an outer diameter equal to or smaller than the inner diameter of the housing, so that the resilient contact member may, after being inserted into the housing, abut with said slanting portion against the second compression spring means, thereby generating a desired contact pressure force between the peripheral contacting portion and the inner wall of the housing.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS

Figure 1:
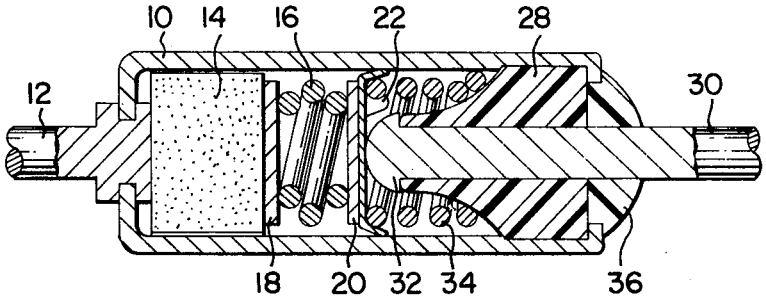
FIG. 1 is a longitudinal cross section showing a thermal fuse of an embodiment of the present invention in a circuit closing condition.
Figure 2:
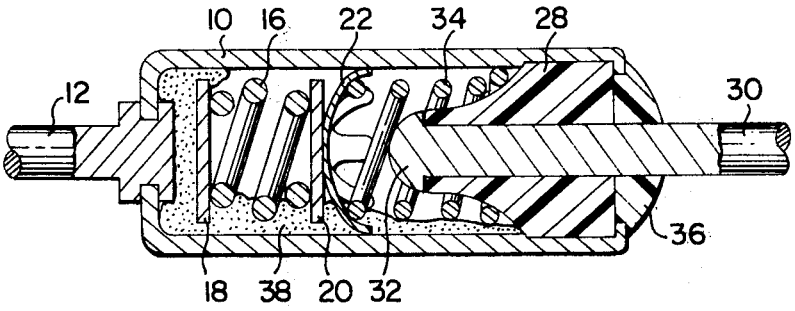
FIG. 2 is a longitudinal cross section showing the fuse in its circuit breaking condition after the pellet has melted.

Referring to the drawings, FIGS. 1 and 2 show cross sections of different states of the temperature responsive electrical fuse switch of an embodiment of the present invention. The thermal fuse of the present invention comprises a cylindrical electrically and thermally conductive housing 10 made of metal, such as copper. A first lead-in wire 12 made of electrically conductive copper, or the like, seals one end of the cylindrical housing. Within the housing 10, there is a temperature-sensitive pellet 14, which fuses at a given temperature. The pellet 14 is molded under proper pressure to form, e.g., a cylinder made of a chemical powder, for example, anhydrous phtalic acid, salicylic acid, levulose, and glucose. A first compression spring 16 is inserted under compression between the disc-like metallic plates 18 and 20, made of electrically conductive copper. A slidable resilient contact member 22, made of electrically conductive silver, or an alloy including silver, is provided adjacent to the plate 20. The contact member 22, having a center contact portion at the bottom base 24 and a peripheral contact portion with a plurality of tongues or fingers 26, integrally formed with the bottom base. The peripheral ends of the contact fingers 26 against the inner wall of the metallic housing 10.

The open end of the housing 10 is closed by an insulator 28 of ceramics, or the like. A second lead-in wire 30 passes through the center of the insulator closure 28. The lead-in wire 30 has a contact portion 32 at its inner end. A second compression spring 34 is inserted in the housing 10 in compression between the slidable, resilient contact member 22 and the insulator closure 28. The housing 10 is hermetically sealed by a compound 36 of a synthetic resin, thereby fixedly securing the metallic housing 10, the insulator 28, and the second lead-in wire 30 in an air-tight structure.

Figure 4:
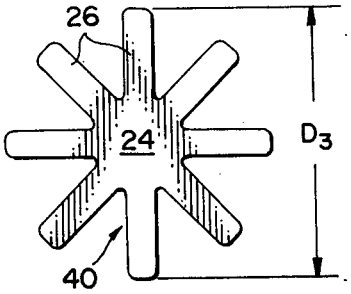
FIG. 4 is a front view of the contact member of FIG. 3 before being shaped.
Figure 5:
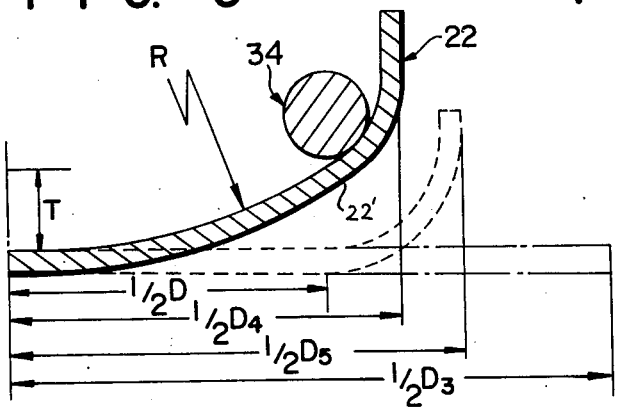
FIG. 5 is an enlarged cross section view of the contact member employed in the thermal fuse of the invention, when the contact member is either subjected to an external force or to no external force.

In other words, the contact member 22 is prepared by shaping a resilient metal sheet 40, as shown in FIG. 4, which has an outer diameter $D_3$ larger than the inner diameter $D_2$ of the housing 10. The external shape of the contact member 22 which is an important feature of the present invention, includes a portion 22' that slopes over the bottom base and the tongues 26 as illustrated in the partial, enlarged view of FIG. 5. The solid line in FIG. 5 illustrates the state before assembling the contact member 22 into the housing 10, similar to the state after the thermal fuse has opened the circuit as shown in FIG. 2. The dotted line illustrates the imaginary state after assembling the contact member 22 in the housing 10.

Figure 3:
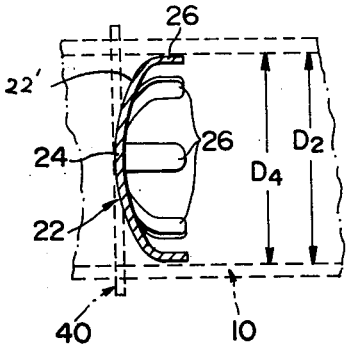
FIG. 3 is a side cross section view of a slidable resilient contact member employed in the thermal fuse of FIG. 1.

In the condition of the assembled state within the housing 10, the bias force of the second compression spring 34 is applied to the contact member 22. Due to the fact that the contact member 22 of the present invention has the centrally convexed form 22' as shown in FIG. 3, a mechanized or automated assembly line production may be easily used for manufacturing the present thermal fuse. In the practical case, the shaped form of the centrally-convex bottom surface may be designed as a circular arc, as shown in FIG. 3. The outer diameter $D_4$ of the shaped contact member 22 in the free, unassembled state is equal to or slightly smaller than the inside diameter $D_2$ of the housing 10. However, when the contact member 22 is deformed by applying the bias force of the second compression spring 34, the portion 22' that slopes over the bottom base 24, and the tongues 26, may be forced down for a distance T so as to expand the outer diameter from the solid line $D_4$ to the dotted line as shown in FIG. 5.

Since the expanded outer diameter $D_5$ is larger than the inner diameter $D_2$ of the housing 10, sufficient contact force between the tongues 26 and the inner wall of the housing 10 can be achieved, similar to the outer diameter $D_1$ of the conventional contact member. The relation of these diameters is expressed as follows:

$$D_3 > D_1 \approx D_5 > D_2 \geqslant D_4$$

The compression springs 16 and 34 are formed so that the spring has a greater resiliency than the spring 34. The spring 34 has a greater restoring dimension or stroke, than the spring 16. Hence, the spring 16 is restricted from being moved to the left by means of the temperature-sensitive pellet 14, whereby the slidable resilient contact member 22 is intensively biased against the contact portion 32 at the inner end of the second lead wire 30 due to a greater spring force of the first spring 16 than that of the second spring 34. In this condition, the lead wires 12 and 30 are conductive through the following path: the first lead-in wire 12, metallic housing 10, slidable resilient contact member 22, contact portion 32 and second lead-in wire 30.

Since the above thermal fuse is connected in series with electric apparatus and located at the temperature-rising portion thereof, when the temperature of such electric apparatus abnormally rises in excess of the melting point of the sensitive pellet 14, the pellet 14 melts thereby opening the circuit and preventing the machinery from being over-heated. Thus, a fire may be avoided. FIG. 2 shows the fuse after the pellet 14 has fused or melted. The molten material 38 undergoes a reduction in volume compared to its original solid state. The melting pellet material simultaneously flows out towards the first compression spring 16 through a gap between the inner wall of housing 10 and the metallic plate 18. Hence, the first compression spring 16 is released from the restriction of the previous contact pressure force by the reduced volume of the temperature-sensitive material 38, whereby the second compression spring 34 expands, as a result, the metallic plates 18 and 20, the first compression spring 16 inserted therebetween, and the slidable resilient contact member 22 are moved leftward in FIG. 2, so that the contact member 22 leaves the contact portion 32 of the inner end of the second lead-in wire 30. Therefore, the non-conductive spacing between the contact member 22 and the contact portion 32 opens the circuit between the wires 12 and 30.

The thermal fuse of the invention has the advantage that when the contact pressure force of the slidable resilient contact member 22 on the inner wall of housing 10 is less than the resilient force of the second spring 34, the resilient contact member 22 may easily be moved leftward due to the melting of the pellet 14, whereby the contact member 22 can leave the contact portion 32 of the second lead wire 30 without a spark generation due to a rapid departure speed. A wide gap between the resilient contact member 22 and the contact portion 32 of the second lead wire 30 causes a desired high breakdown voltage.

Figure 6:
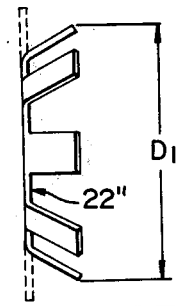
FIG. 6 is a side view showing the contact member of the prior art.

In this regard, the slidable resilient contact member 22 of the present invention, a side view of which is shown in FIG. 3, differs from the conventional contact member 22'' of FIG. 6 in that the bottom base 24 of the contact member 22 is convex-shaped, and the outer diameter $D_4$ of the contact member 22 is formed approximately equal to or smaller than the inner diameter $D_2$ of the metallic housing 10. Further, the slidable resilient contact member 22 is designed to be somewhat less resilient than the second compression spring 34.

Hence, as shown in FIG. 1, the convex bottom 24 of the resilient contact member 22 is, prior to its assembly in the housing 10, connected to the flat portion of the metallic plate 20. The concave surface of the contact member 22 is biased by the compression spring 34 having a greater resiliency than the contact member 22 as such. As a result, the resilient contact member 22 is deformed so that the bottom base 24 becomes substantially rectangular with respect to the bent ends of the tongues 26, whereby the tongues 26 strongly contact the inner wall of the metallic housing 10, keeping both lead wires 12 and 30 conductive therebetween.

For example, when the convex surface 22' of the contact member 22 of the present invention was shaped as a circular arc of the radius R under the condition that the outer diameter $D_4 = 3.5$ mm for the use in the housing 10 having an inner diameter $D_2 = 3.6$ mm, the following relations were obtained:

| R | T | $D_5$ | $D_5 - D_2$ |
|---|---|---|---|
| 3.42 | 0.30 | 3.90 | 0.3 |
| 3.00 | 0.35 | 3.97 | 0.37 |

It is noted that the contact pressure force between the contact member 22 and the housing 10 is proportional to the value ($D_5$ - $D_2$), the deformed distance of the tongues 26.

Now, the temperature-sensitive pellet 14 in its molten condition allows the resilient contact member 22 to return to the form shown in FIG. 3. Hence, a minimum gap is formed between the metallic housing 10 of the inner diameter $D_2$ and the shaped resilient contact member 22 of the outer diameter $D_4$ which is smaller than $D_2$. This gap weakens the contact pressure force of the tongues 26 of the resilient contact member 22 against the inner wall of the metallic housing 10 so that the resilient contact member 22 may leave the contact portion 32, rapidly and exactly, in a regular space, by means of the second compression spring 34, thereby preventing occurrence of a spark in action and also fully rising the breakdown voltage after working of the thermal fuse.

Incidentally, the above embodiment refers to the member 22 as the slidable resilient contact member 22, to which no external force is applied, and which has an outer diameter $D_4$ smaller than the inner diameter $D_2$ of the metallic housing 10. However, the member 22 may, in the alternative have substantially the same diameter as $D_2$ and substantially the same effect is achieved.

The manufacturing of the thermal fuse of the present invention will now be described. The first lead-in wire 12 is first secured or sealed into the metallic housing 10. The circuit breaker pellet 14 is then inserted into the housing, followed by the metallic plate 18, the first compression spring 16, the metallic plate 20, and the slidable, resilient contact member 22. In this insertion process, the contact member 22 is easily insertable because its outer diameter is equal to or smaller than the inner diameter of the housing 10. The contact member 22 is prepared by a punching and shaping process. Such processes are of course automatically controllable. Second, the contact member 22 inserted in the housing 10 is accurately centrally located, and the sloping portion 22' of the circular arc of member 22 contacts the second compression spring 34 secured to the insulator 28. The spring 32 biases the member 22. The biasing force deforms the contact member 22 to be bent substantially flat with respect to the metallic plate 20 so that the peripheral contacting portions of each of the tongues 26 may be elastically expanded radially from the bottom 24 of the contact member 22.

In view of the above description of the present invention, it will be appreciated that the slidable resilient contact member 22 is shaped in such a manner that in the absence of an external force, the member 22 is cross-sectionally curved to have a substantially circular arc, as shown, for example, in FIG. 3. Therefore, when the temperature-sensitive pellet 14 melts, the contact member 22 slides very smoothly by expansion of the second compression spring, and the quick release of the contact member from the contact portion of the inner end of the second lead-in wire eliminates the generation of a spark. Also, the spacing between the slidable resilient contact member after its motion and the contact portion of the inner end of the second lead wire is made to effectively raise the breakdown voltage. The quality of the thermal fuse is made uniform not only because of its easy construction of the slidable resilient contact member 22, but also because the thermal fuse may be mechanically and automatically manufactured by mass production so that it is inexpensive.

Although the invention has been described with reference to specific example embodiments, it is to be understood that it is intended to cover all modifications and equivalents within the scope of the appended claims.

What is claimed is:

1. A temperature responsive electric switch comprising:

a. a cylindrical, electrically and thermally conductive housing having an open-ended portion;
b. a first lead wire fixedly secured to said housing;
c. switch parts housed in said housing in a certain order, said switch parts including a temperature-sensitive pellet fusible at a predetermined temperature, a first metallic retaining plate, a first compression spring, a second metallic retaining plate, a slidable resilient contact member, and a second compression spring, said slidable resilient contact member having a curved shape with a convex bottom portion in the absence of an external force;
d. an insulator closing the open-ended portion of said housing;
e. a second lead wire passing through said insulator and having a contact portion at the inner end thereof; and
f. hermetical sealing means of insulating material integrally secured to said housing, to said insulator and to said second lead wire so as to electrically couple said first lead wire and said second lead wire through said contact member, and wherein the contact member is provided with a center contact portion and a peripheral contact portion, said peripheral contact portion being electrically connected to the inner surface of said housing with a contact force corresponding to the biasing force of said second spring on said contact member.

2. The electric switch of claim 1, wherein the outer diameter of said contact member is equal to or smaller than the inside diameter of said housing in the absence of an external force.

3. In a temperature responsive electric switch provided with a thermal fuse comprising a metallic, cylinderical housing having one open end, a first lead-in member electrically secured to said housing, a temperature-sensitive pellet fusible at a predetermined temperature in said housing, retaining plates held opposite to each other by spring means having a comparatively strong resiliency within said housing, a slidable resilient contact member having a central contacting portion and a peripheral contacting portion, a compression spring of comparatively weak resiliency disposed within said housing and between an insulator and said contact member, insulating material hermetically sealing the open end of said housing, and a second lead-in member passing through said insulator and insulating material and having at the tip a contact portion so that the resilient contact member is biased at its peripheral contacting portion against the inner wall of said housing and at the central contacting portion against the contact portion of said second lead member, the improvement wherein said resilient contact member comprises a structure in which the central contacting portion and the peripheral contacting portion are formed as an integral, punched element including a sloped portion between the central portion and the peripheral portion, said integral element having an outer diameter of the peripheral portion equal to or smaller than the inner diameter of said housing, so that the resilient contact member, after insertion into said housing, abuts at the sloped portion thereof against said compression spring, thereby generating a contact pressure force between the peripheral contacting portion and the inner wall of said housing.

4. The thermal fuse of claim 3, wherein said central contacting portion is formed by a bottom base and said peripheral contacting portion is formed by a plurality of tongues integral to and radially extending from said bottom base in said contact member.

5. A method for making a thermal fuse having, within a housing, switch elements including a temperature-sensitive pellet, a slidable resilient contact member and compression spring means, comprising the following steps:

a. preparing said contact member by punching a sheet of resilient material to form a bottom base and an integral plurality of tongues, and shaping said punched sheet to provide a sloped portion extending between said bottom base and said tongues and further providing said bottom base with such an inherent bias that the bottom base has a curved shape with a convex bottom portion in the absence of an external force, making the outer diameter of said shaped sheet equal to or smaller than the inner diameter of said housing; and
b. inserting said switch parts into said housing case so as to complete said thermal fuse.

* * * * *